US007311494B2

(12) United States Patent
Farag et al.

(10) Patent No.: US 7,311,494 B2
(45) Date of Patent: Dec. 25, 2007

(54) FAN AND SCROLL DESIGN FOR HIGH EFFICIENCY AND LOW NOISE

(75) Inventors: Ashraf Farag, East Amherst, NY (US); Steven C. Guzy, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 112 days.

(21) Appl. No.: 11/222,060

(22) Filed: Sep. 8, 2005

(65) Prior Publication Data

US 2007/0053774 A1 Mar. 8, 2007

(51) Int. Cl.
*F04D 29/44* (2006.01)

(52) U.S. Cl. ..... 415/206; 416/187; 416/195

(58) Field of Classification Search ..... 415/119, 415/203, 204, 206; 416/187, 195, 196 R
See application file for complete search history.

(56) References Cited

U.S. PATENT DOCUMENTS 4,432,694 A 2/1984 Kuroda et al.
5,839,879 A 11/1998 Kameoka et al.
6,132,170 A * 10/2000 Horng ..... 415/178
6,146,092 A 11/2000 Botros et al.
6,224,335 B1 5/2001 Parisi et al.
6,781,835 B2 * 8/2004 Hashimoto et al. ..... 361/697
2003/0235496 A1 12/2003 Eaton et al.

FOREIGN PATENT DOCUMENTS

| | | |
|---|---|---|
| DE | 10051954 | 5/2002 |
| EP | 1411247 | 4/2004 |
| JP | 2004353665 | 12/2004 |
| WO | 2004097225 A | 11/2004 |

* cited by examiner

*Primary Examiner*—Edward K. Look
*Assistant Examiner*—Dwayne J White
(74) *Attorney, Agent, or Firm*—Patrick M. Griffin

(57) ABSTRACT

A centrifugal fan assembly including a housing having a lower surface and a parallel inlet wall that defines an inlet opening. A shaft is supported by the housing for rotating about an axis. A plurality of fan blades are disposed about the shaft and extend radially from the axis for drawing air axially into the fan blades and blowing air radially outwardly. The housing defines a scroll wall that spirals about the axis and defines an outlet air passage that extends substantially tangentially to the axis. The fan blades include extensions that extend through the inlet opening and outside of the inlet wall.

14 Claims, 7 Drawing Sheets

FAN AND SCROLL DESIGN FOR HIGH EFFICIENCY AND LOW NOISE

BACKGROUND OF THE INVENTION

1. Field of the Invention

The subject invention relates to centrifugal fan assemblies.

2. Description of the Prior Art

In the prior art, numerous centrifugal fan assemblies are disclosed for drawing air axially into the center and throwing the air radially. Such centrifugal fan assemblies include a housing having a lower surface and an inlet wall defining an inlet opening and a shaft supported by the housing for rotating about an axis aligned with the inlet opening. A plurality of fan blades are disposed about the shaft and extend radially from the axis for drawing air axially into the blades and for blowing air radially outwardly. The housing defines a scroll wall spiraling about the axis to an outlet air passage that extends substantially tangentially to the axis. An example of a centrifugal fan assembly is shown in U.S. Pat. No. 6,893,220, issued to Eaton et al.

Some centrifugal fan assemblies can produce objectionable noise and do not obtain sufficient efficiency.

SUMMARY OF THE INVENTION AND ADVANTAGES

The present invention provides such a centrifugal fan assembly distinguished by the fan blades including extensions that extend through the inlet opening and outside of the inlet wall for drawing air axially into the fan blades.

The present invention provides a centrifugal fan assembly that results in reduced noise output and increased efficiency of the assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
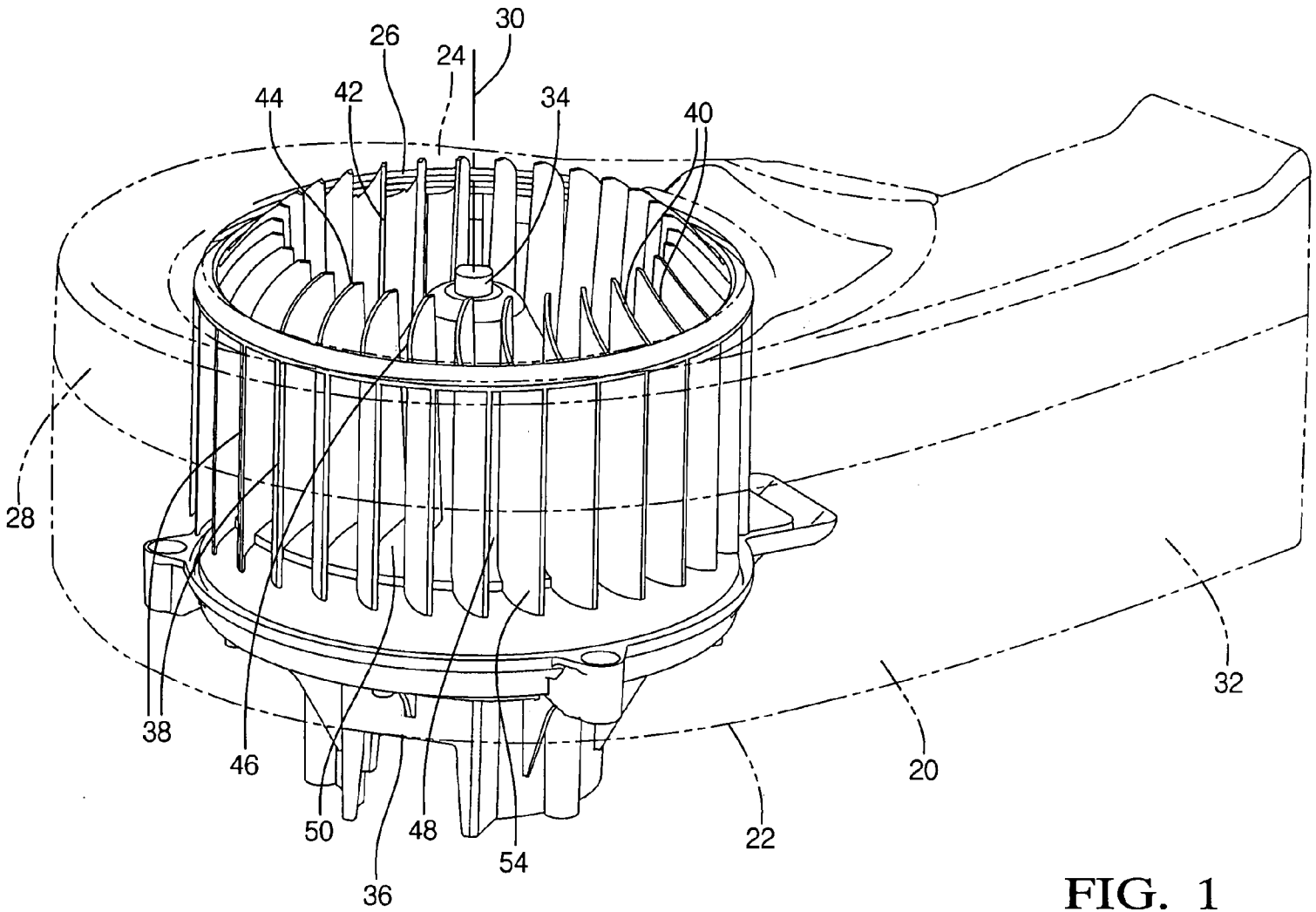
FIG. 1 is a plan view of a centrifugal fan assembly of the present invention.
Figure 2:
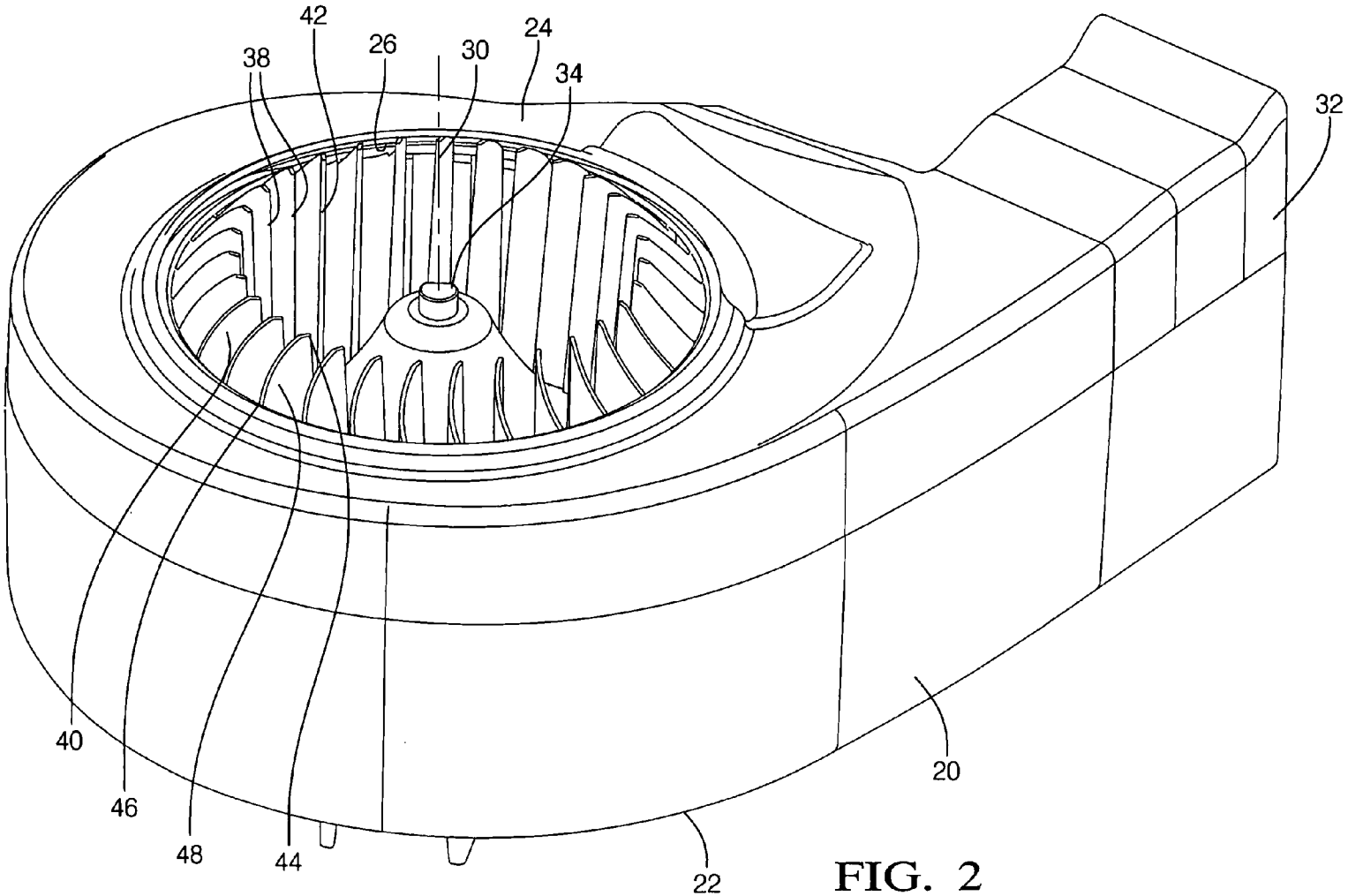
FIG. 2 is an alternate plan view of the assembly shown in FIG. 1.
Figure 3:
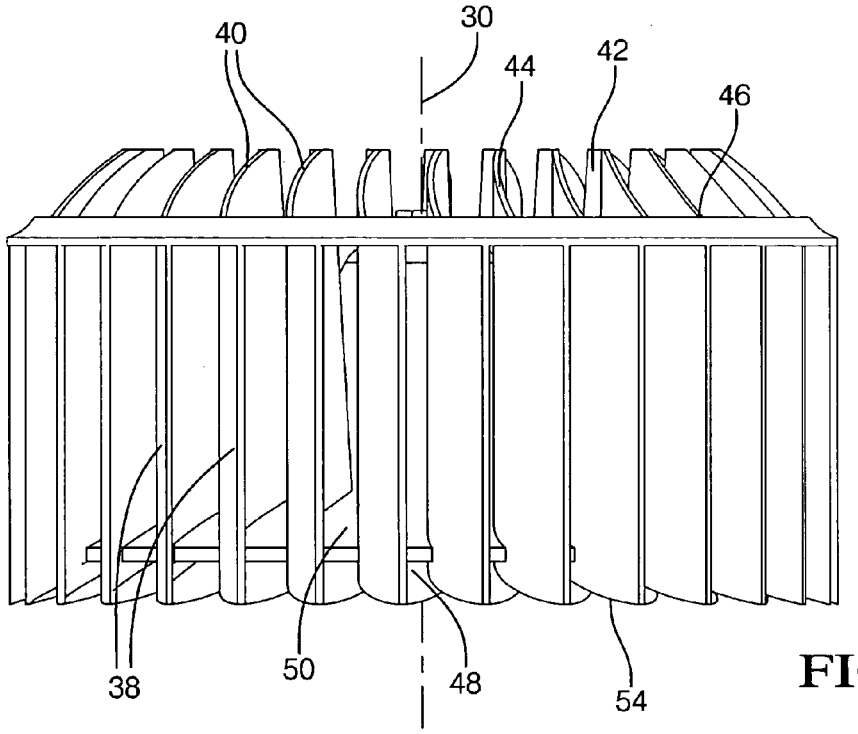
FIG. 3 is a side view of a plurality of fan blades of the centrifugal fan assembly shown in FIG. 2.
Figure 4:
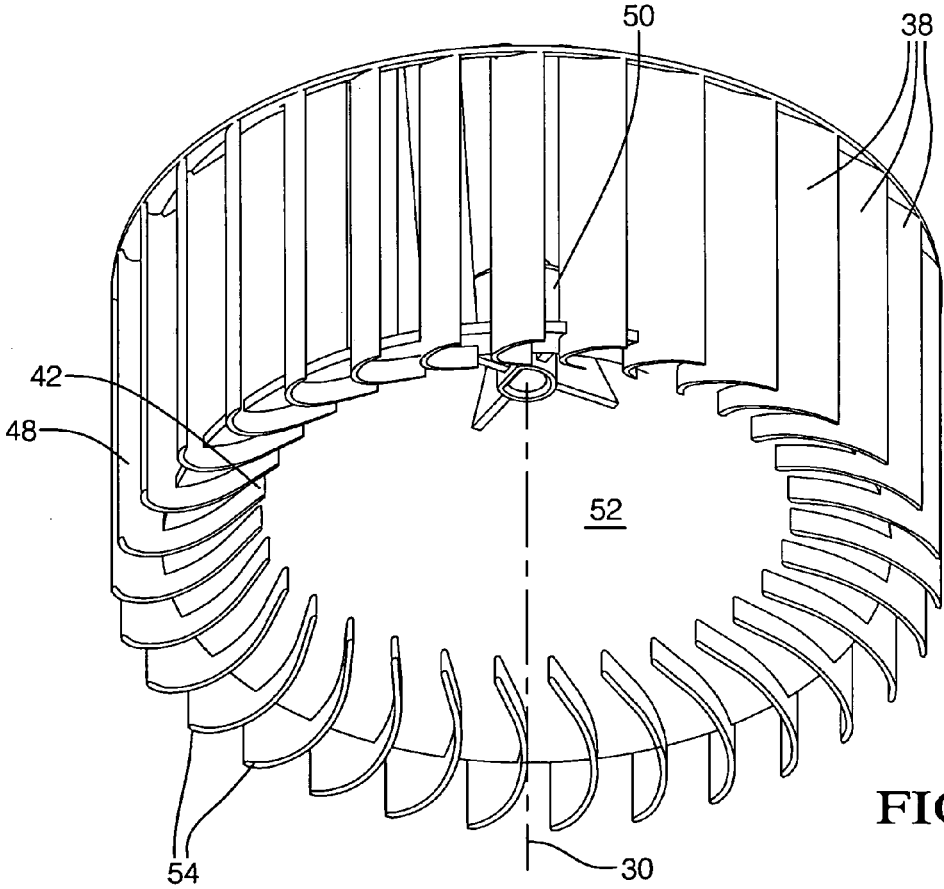
FIG. 4 is a bottom view of a hub interconnecting the fan blades of the assembly shown in FIG. 3.
Figure 5:
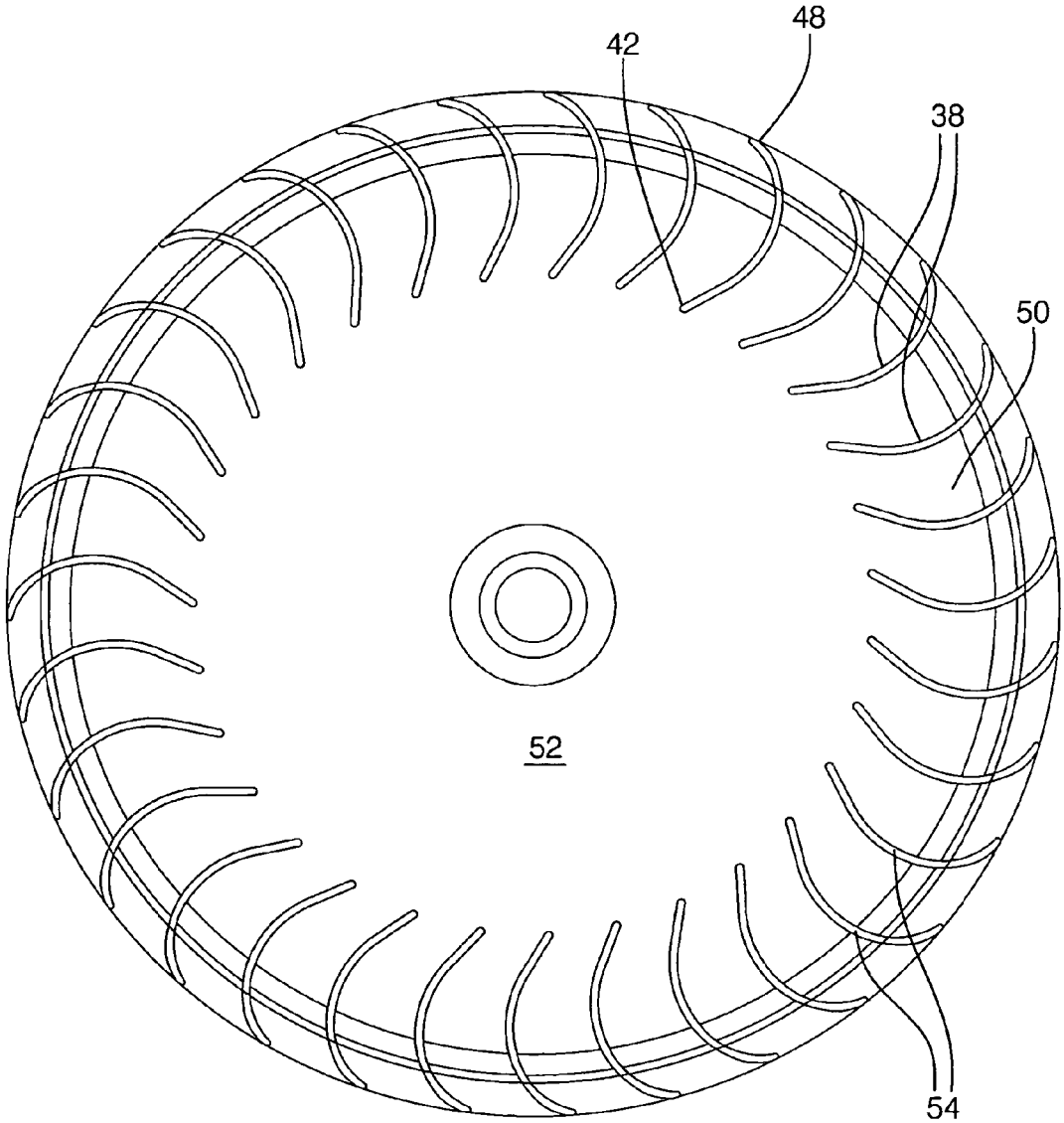
FIG. 5 is an alternate bottom view of the hub interconnecting the fan blades of the assembly shown in FIG. 4.
Figure 6:
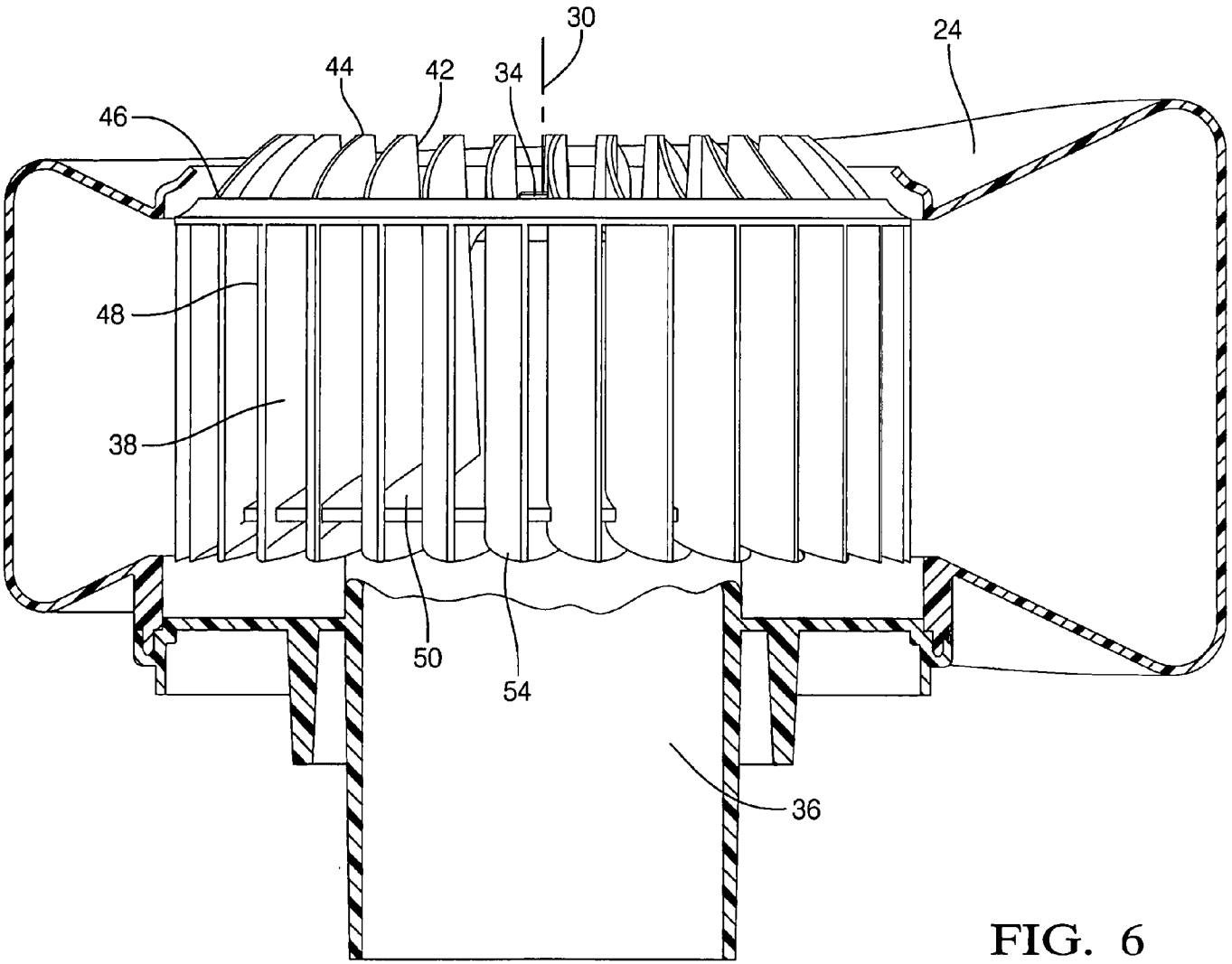
FIG. 6 is an alternate side view of the plurality of blades of the assembly shown in FIG. 3.
Figure 7:
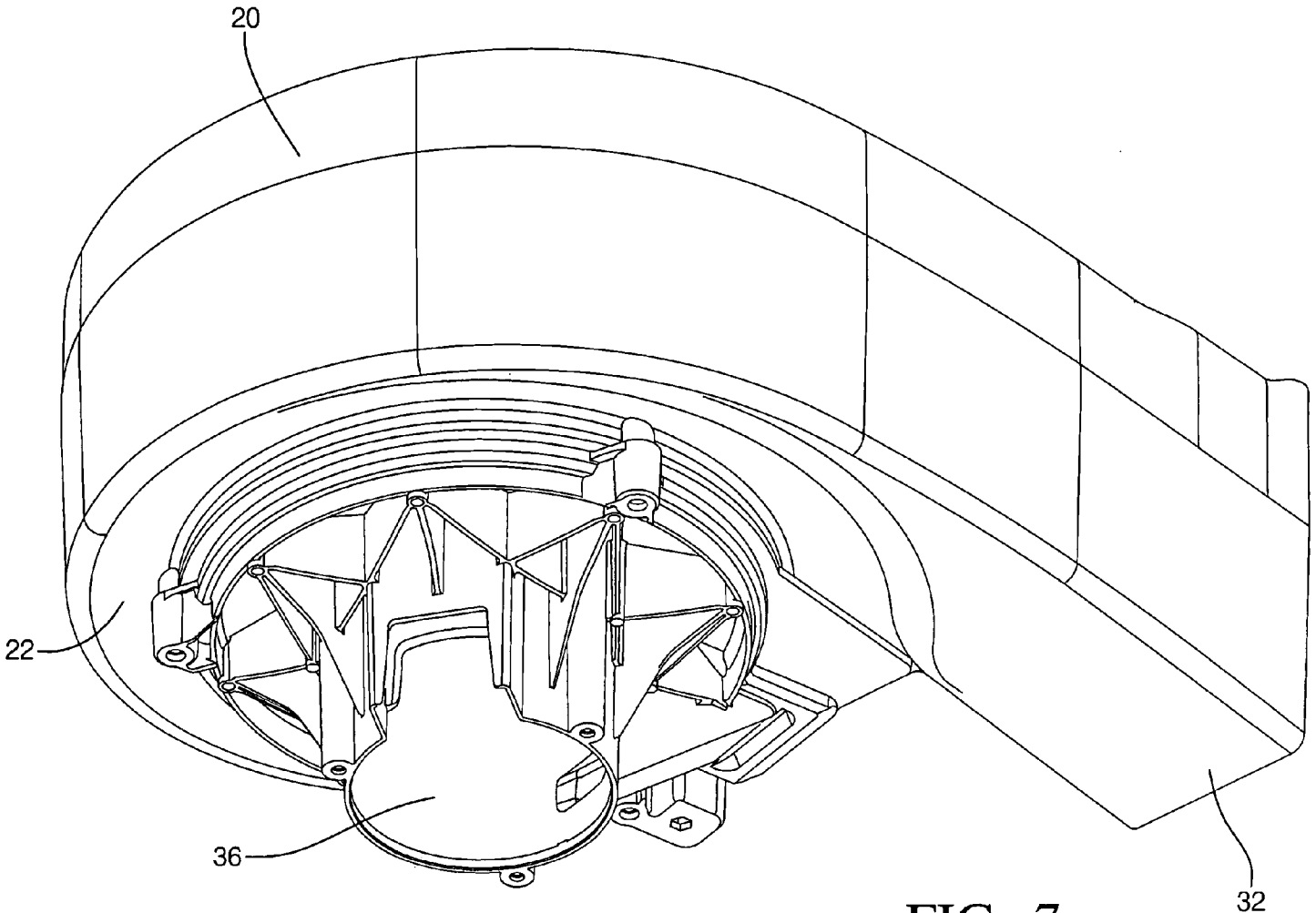
FIG. 7 is a perspective view of a housing of the assembly shown in FIG. 1.
Figure 8:
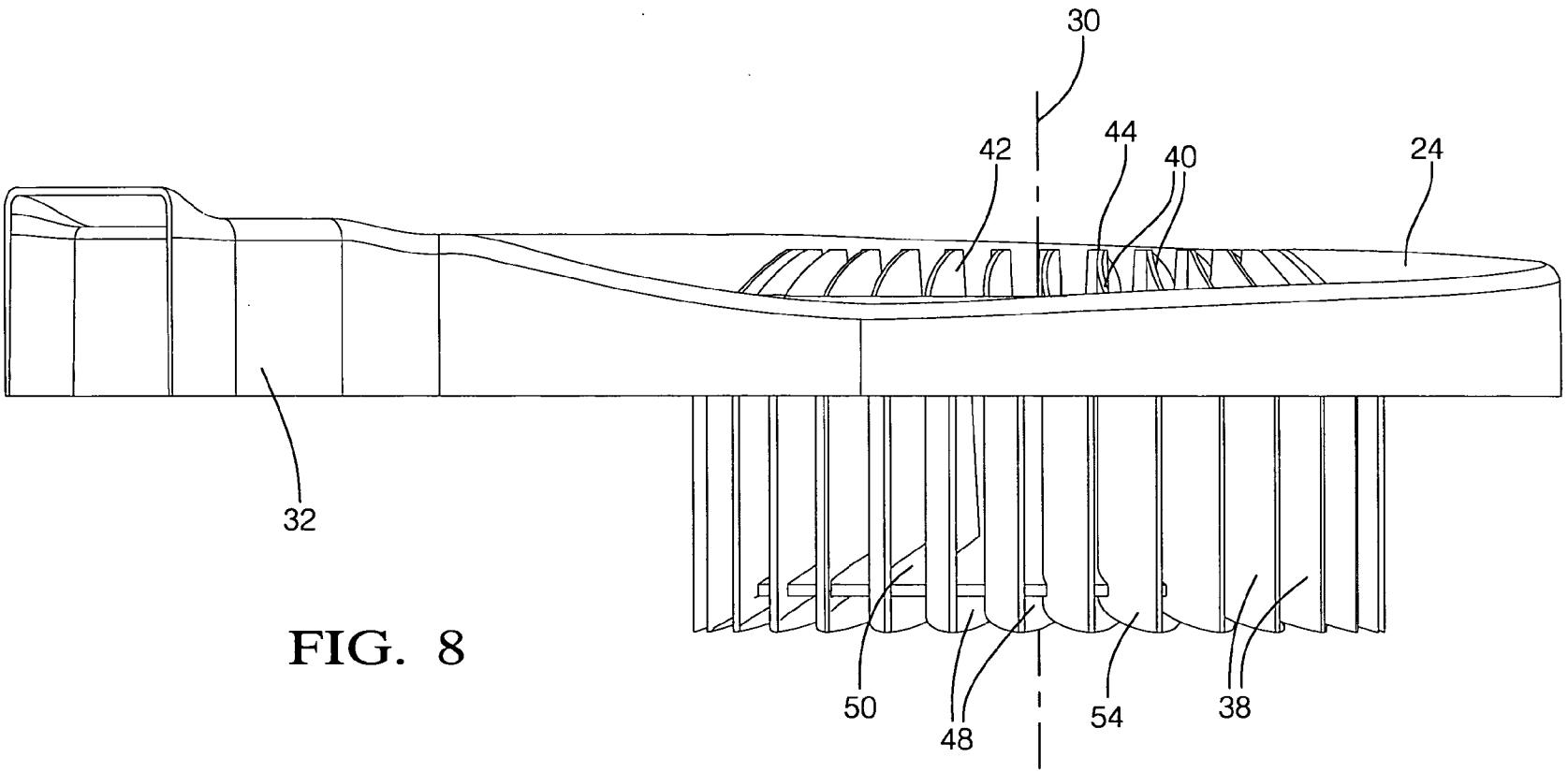
FIG. 8 is an alternate side view of the plurality of blades shown in FIG. 6.

Referring to the Figures, wherein like numerals indicate corresponding parts throughout the several views, a centrifugal fan assembly is shown.

The assembly includes a housing 20 having a lower surface 22 and an inlet wall 24 defining an inlet opening 26 that is circular. The housing 20 further defines a scroll wall 28 that spirals about an axis 30 and defines an outlet air passage 32 that extends substantially tangentially to the axis 30. The housing 20 is formed as a diffuser for optimal conversion of kinetic energy to potential energy.

The assembly also includes a shaft 34 being supported by the housing 20 for rotating about the axis 30 that is aligned with the inlet opening 26. The shaft 34 is configured to allow a motor 36 to rotate the shaft 34.

A plurality of fan blades 38 are disposed about the shaft 34 and extend radially from the axis 30 for drawing air axially into the fan blades 38 and blowing air radially outwardly into the outlet air passage 32.

The assembly is distinguished by each fan blade 38 including an extension 40 that extends through the inlet opening 26 and projects outside of the inlet wall 24 for drawing air axially into the fan blades 38.

Furthermore, each fan blade 38 includes an interior edge 42 that is located within the inlet opening 26 and is spaced radially from the axis 30. The interior edge 42 extends parallel to the axis 30 to a pointed peak 44. Each pointed peak 44 extends through the inlet opening 26 and outward of the inlet wall 24 for drawing air axially into the fan blades 38. Additionally, each pointed peak 44 extends from a junction 46 at an exterior periphery 48 upwardly to the interior edge 42. Each junction 46 is disposed axially inside of the inlet opening 26. The exterior periphery 48 of each fan blade 38 is parallel to the axis 30. By example and not meant to be limiting, the inlet opening 26 may include a rim (not shown) that is substantially planar and parallel to the axis 30 wherein the exterior periphery 48 of the fan blade 38 attaches to.

The fan blades 38 are aerodynamically curved and interconnected by a hub 50 having a bottom 52. The fan blades 38 are disposed radially about the hub 50 and oriented such that the curve in each fan blade 38 is in the same direction for blowing air in uniform volume radially outwardly into the outlet air passage 32.

Each fan blade 38 further includes an aft end 54 that is located opposite the extensions 40. The aft end 54 of each fan blade 38 tapers upwardly and extends beyond the hub 50. The aft end 54 of each fan blade 38 and the bottom 52 of the hub 50 align with the lower surface 22 of the housing 20 for providing smooth air flow transition.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A centrifugal fan assembly comprising:

a housing having a lower surface and an inlet wall defining an inlet opening, a shaft supported by said housing for rotating about an axis aligned with said inlet opening, a plurality of fan blades disposed about said shaft and extending radially from said axis for drawing air axially into said fan blades and blowing air radially outwardly, wherein each fan blade includes an interior edge within said inlet opening and spaced radially from said axis, said housing defining a scroll wall spiraling about said axis and defining an outlet air passage extending substantially tangentially to said axis, and characterized by said fan blades including extensions extending through said inlet opening and outside of said inlet wall for drawing air axially into said fan blades.

2. An assembly as set forth in claim 1 wherein each fan blade includes an exterior periphery parallel to said axis.

3. An assembly as set forth in claim 2 wherein each fan blade includes a pointed peak extending through said inlet opening and outward of said inlet wall for drawing air axially into said fan blades.

4. An assembly as set forth in claim 3 wherein each pointed peak extends from a junction at said exterior periphery upwardly to said interior edge.

5. An assembly as set forth in claim 4 wherein each junction is disposed axially inside of said inlet wall.

6. An assembly as set forth in claim 5 wherein said interior edge extends parallel to said axis to said pointed peak.

7. An assembly as set forth in claim 6 wherein said fan blades are aerodynamically curved.

8. An assembly as set forth in claim 7 further including a hub interconnecting said fan blades.

9. An assembly as set forth in claim 8 wherein said hub includes a bottom.

10. An assembly as set forth in claim 9 wherein said fan blades being disposed radially about said hub are oriented such that the curve in each fan blade is in the same direction for blowing air in uniform volume radially outwardly into said outlet air passage.

11. An assembly as set forth in claim 10 wherein each fan blade further includes an aft end located opposite said extensions that tapers upwardly and extends beyond said hub.

12. An assembly as set forth in claim 11 wherein said aft end of each fan blade and said bottom of said hub align with said lower surface of said housing for providing smooth air flow transition.

13. An assembly as set forth in claim 11 wherein said inlet opening is circular.

14. An assembly as set forth in claim 12 further including a motor rotating said shaft.

* * * * *